US006418624B1

(12) United States Patent
Huang

(10) Patent No.: US 6,418,624 B1
(45) Date of Patent: Jul. 16, 2002

(54) ARTIST'S KNIFE HAVING AN AUTOMATICALLY RETRACTABLE BLADE

(76) Inventor: Harrison Huang, No. 23, Lin T'So Road, Sheng Kang Hsian, Taichung Hsien (TW)

( * ) Notice: Subject to any disclaimer, the term of this patent is extended or adjusted under 35 U.S.C. 154(b) by 0 days.

(21) Appl. No.: 09/672,301

(22) Filed: Sep. 29, 2000

(51) Int. Cl.[7] ..... F41C 27/18
(52) U.S. Cl. ..... 30/162; 30/2; 30/329
(58) Field of Search ..... 30/2, 162, 335, 30/163, 289, 314, 329, 294, 349, 351, 337, 339

(56) References Cited

U.S. PATENT DOCUMENTS 1,936,016 A * 11/1933 Hay ..... 30/329
2,413,082 A * 12/1946 Skaer ..... 30/162
2,743,523 A * 5/1956 Honey ..... 30/329
3,453,729 A * 7/1969 Larson ..... 30/162
4,389,776 A * 6/1983 Okada ..... 30/162
4,899,443 A * 2/1990 Beermann ..... 30/2
5,433,004 A * 7/1995 Thompson ..... 30/169
5,475,925 A * 12/1995 Newmann et al. ..... 30/162
5,813,121 A * 9/1998 Gringer ..... 30/162
6,161,290 A * 12/2000 Takamasa ..... 30/162

* cited by examiner

*Primary Examiner*—Kenneth E. Peterson
*Assistant Examiner*—Omar Flores-Sánchez
(74) *Attorney, Agent, or Firm*—Browdy and Neimark, P.L.L.C.

(57) ABSTRACT

An artist's knife is formed of a main body, an end retaining member, a guide member, and an elastic member. The main body is provided in one side with a long hole. The end retaining member is disposed at one end of the main body. The guide member is movably disposed in the main body and is provided in one end with a notch in which a blade is disposed. The one end of the guide member can be extracted out of the main body to expose the blade. The elastic member is disposed between the retaining member and the guide member for providing the guide member with a recovery spring force enabling the guide member to return to its initial position after each displacement.

3 Claims, 4 Drawing Sheets

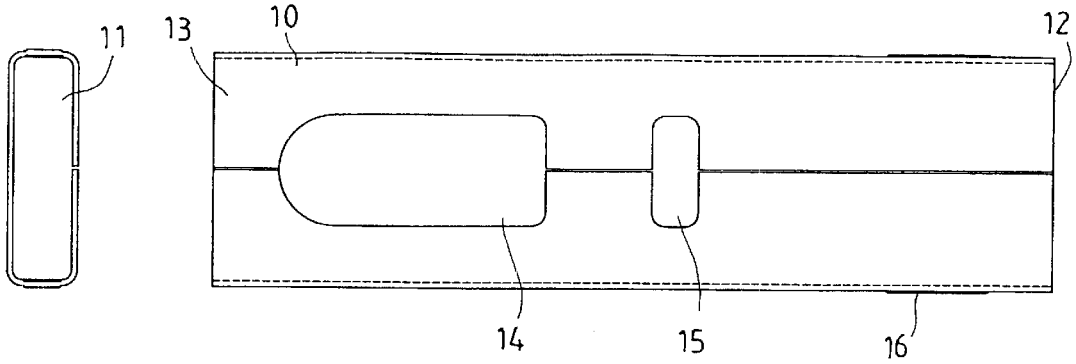
FIG. 2
FIG. 1
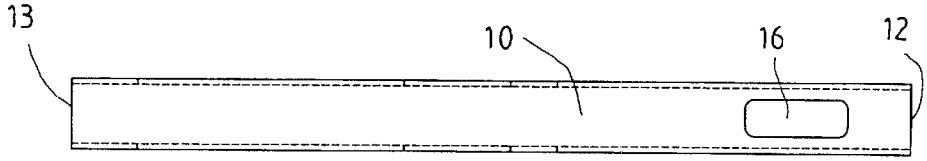
FIG. 3
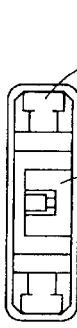
FIG. 5
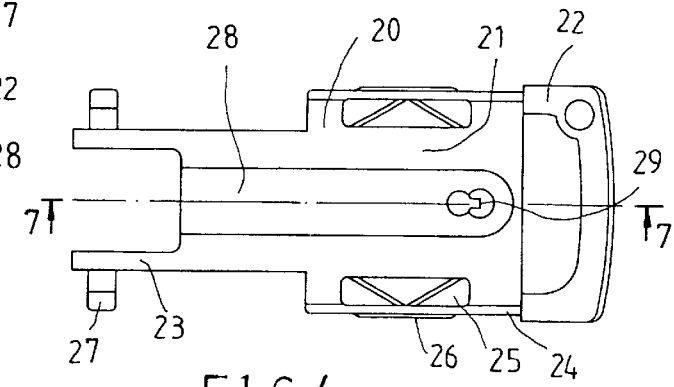
FIG. 4
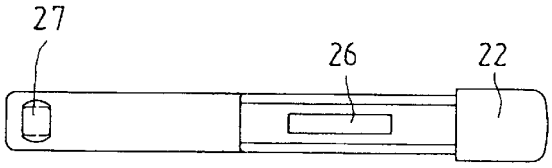
FIG. 6
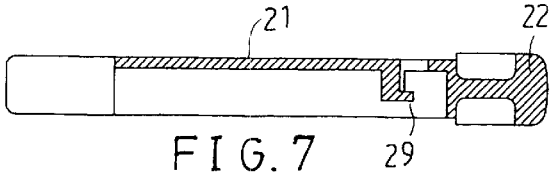
FIG. 7

ARTIST'S KNIFE HAVING AN AUTOMATICALLY RETRACTABLE BLADE

FIELD OF THE INVENTION

The present invention relates generally to an artist's knife, and more particularly to. an artist's knife which has an automatically retractable blade.

BACKGROUND OF THE INVENTION

When an artist is engaged in his or her work, he or she uses an art designing knife repeatedly. As a result, the knife is put aside from time to time in the course of his or her art work, with the knife blade being exposed. The exposed blade of an artist's knife is prone to inflict an injury on the artist at work or a bystander.

SUMMARY OF THE INVENTION

The primary objective of the present invention is to provide an artist's knife with a safety means enabling the blade of the artist's knife to be automatically retracted at the time when the artist's knife is not in use.

The artist's knife of the present invention comprises a main body, an end retaining member, and a guide member. The main body is provided in one side with a long hole. The end retaining member is disposed at one end of the main body. The guide member is disposed movably in the main body and is provided in one end with a notch in which a blade is disposed. The one end of the guide member can be jutted out of the main body to expose the blade. An elastic member is disposed between the retaining member and the guide member for keeping the guide member in the main body and providing the guide member with a recovery force enabling the guide member to move back to its original position.

BRIEF DESCRIPTION OF THE DRAWINGS

FIGS. 1 to 3 shows a front view and left view and back view of the present invention.

FIGS. 4 to 6 shows a front view and left view and back view of the end retaining member of present invention.

FIG. 7 shows a section view of 7—7 in the FIG. 4.

DETAILED DESCRIPTION OF THE INVENTION

Figure 9:
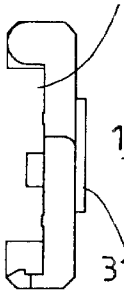
FIGS. 8 to 11 shows a front view and left view and back view and right view of the guide member of the present invention.
Figure 8:
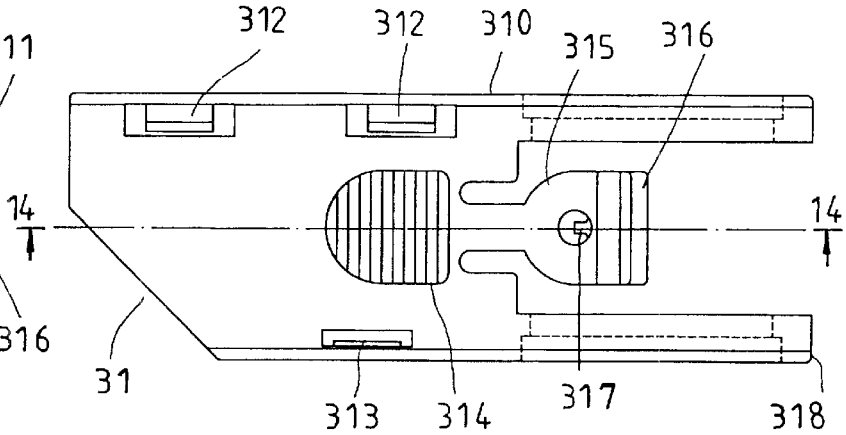
Figure 11:
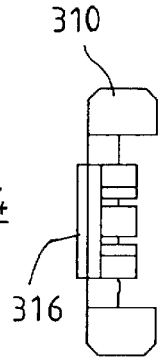
Figure 10:
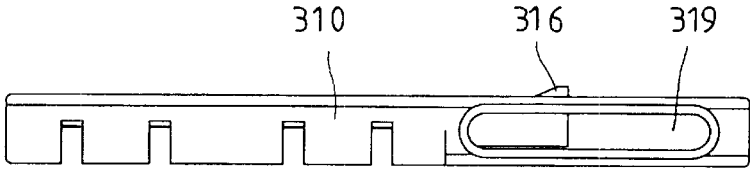
Figure 14:
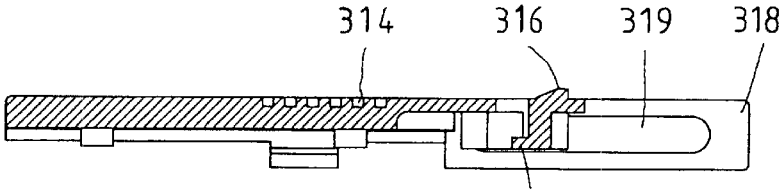
FIG. 14 shows a section view of 14—14 in the FIG. 8.
Figure 13:
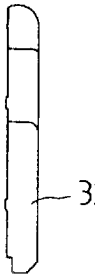
FIG. 13 shows a left view of another guide member.
Figure 12:
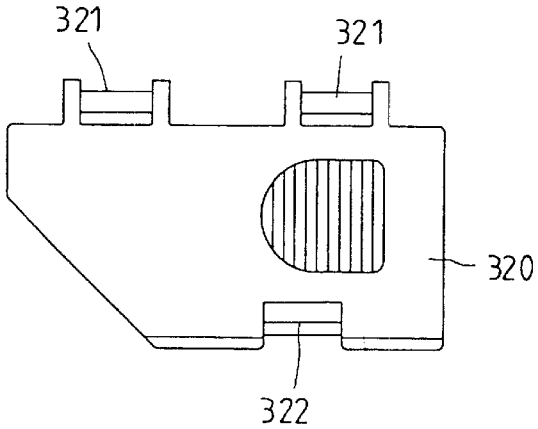
FIG. 12 shows a front view of another guide member.

As shown in all drawings provided herewith, an artist's knife of the present invention comprises the component parts which are described hereinafter.

A main body 10 as FIGS. shows in 1 to 3, is of a rectangular construction and is provided in the interior with a receiving compartment 11. The main body 10 is further provided in two longitudinal ends with a through port 12(13) in communication with the receiving compartment 11. The main body is provided in both sides with a long hole 14 and in one side with a through hole 15. The main body is provided at one end of two narrow sides thereof with a retaining hole 16.

An end retaining member 20 as FIGS. shows in 4 to 7, has a body plate portion 21 which is provided at one end with an end cover portion 22, and at other end with two long arm portions 23 extending outward. The body plate portion is provided in two sides with a side plate 24, which is provided with a through hole 25, thereby enabling two side plates to be pliable. Each side plate is provided with a retaining projection 26. Each of the long arm portions is provided in a long side with a pillar 27. The body plate portion 21 is provided with a recess 28. The recess 28 is provided with a rear hooked portion 29, which near the end cover portion 22. The body plate portion 21 is inserted into the through port 12 such that the end cover portion is jutted out of the main body 10, and that the two projections 26 of the two side plates 24 are retained in the retaining holes 16 of the two narrow sides of the main body.

A guide member 30 as FIGS. shows in 8 to 13, is formed of a long plate body 310 and a blade cover 320 and is movably disposed in the main body such that the guide member is jutted out of the through port 13. The guide member is provided in the projecting end with a slanted in-use notch 31. In the one end of the long plate body is provided a blade mount portion and the notch 31 is provided in the one end of the blade mount portion. The blade mount portion also is provided two hooks 312 in one side and one hook 313 in the other side. The shape of the blade cover homologizes the blade mount portion. There are two hook 321 and a hook 322 provided in both sides of the blade cover and makes the blade cover can wedge at the blade mount portion. The blade cover 320 is provided with a push knob 323 corresponding in location to the long hole 14 of the main body. The long plate body 310 also is provided with a push knob 314 corresponding in location to the long hole 14 of the main body. The long plate body is provided at one end with a pliable arm plate 315 which is provided with a slanted protuberance 316 slanting toward the projecting direction of the guide member to be retained in the through hole 15 of the main body at the time when the guide member is not jutted out of the main body. The pliable arm plate is provided with a front hooked portion 317 located between the slanted protuberance and the push knob. The long plate body is provided in two long sides with a guide arm 318 to enable the pliable arm plate 315 to locate between the two guide arms which are provided with a long guide groove 319. The two guide arm ends of the guide member are inserted into the main body such that the two pillars 27 of the long arm portions 23 are retained in the two long guide grooves 319.

Figure 15:
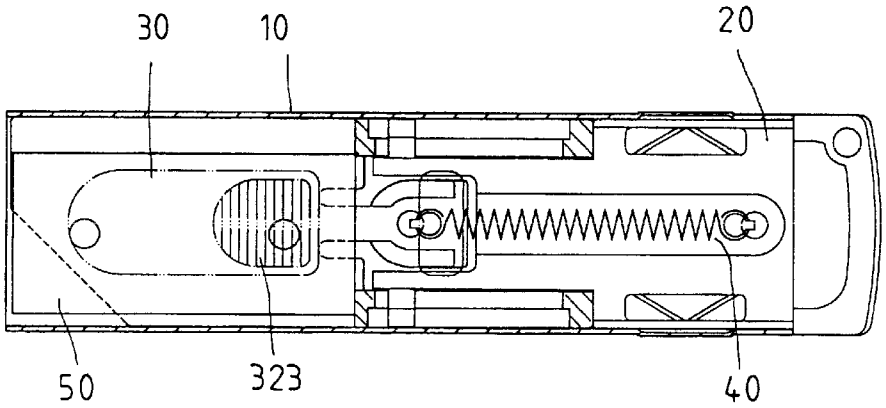
FIG. 15 shows a combination view of present invention before the guide member juts out the main body.

An elastic member 40 as shows in FIG. 15 is a spring, which is disposed in the main body 10 and is retained at one end by the rear hooked portion 28 of the end retaining member, with other end of the spring being retained by the front hooked portion 317 of the guide member 30. The spring provides the guide member with a recovery force enabling the guide member to return to its original position after each displacement.

A blade 50 as shows in FIG. 15 is mounted in the blade mount portion of the long plate body and the blade 50 is sandwiched between the long plate body 310 and blade cover 320 such that one end angle portion is jutted out of the notch 31. The blade is concealed in the main body when the guide member is not extended out. When the guide member is extended out, the blade is jutted out of the main body 10 for work. When the knife of the present invention is use, we only use one corner of the blade. When the used corner is deadened, we can commute another corner to use. That means a blade can commute four times. By the way, we can avoid the danger from breaking the blade.

When the knife of the present invention is not in use as shows in FIG. 15, the guide member 30 is retracted into the main body 10 by the pull force of the spring 40. In the meantime, the slanted protuberance 316 is retained in the through hole 15 of the main body.

Figure 16:
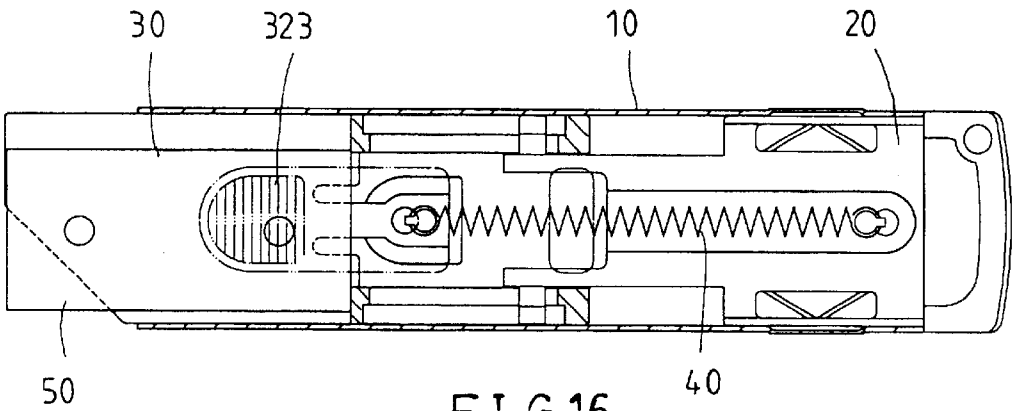
FIG. 16 shows a combination view of present invention when the guide member juts out the main body.
Figure 17:
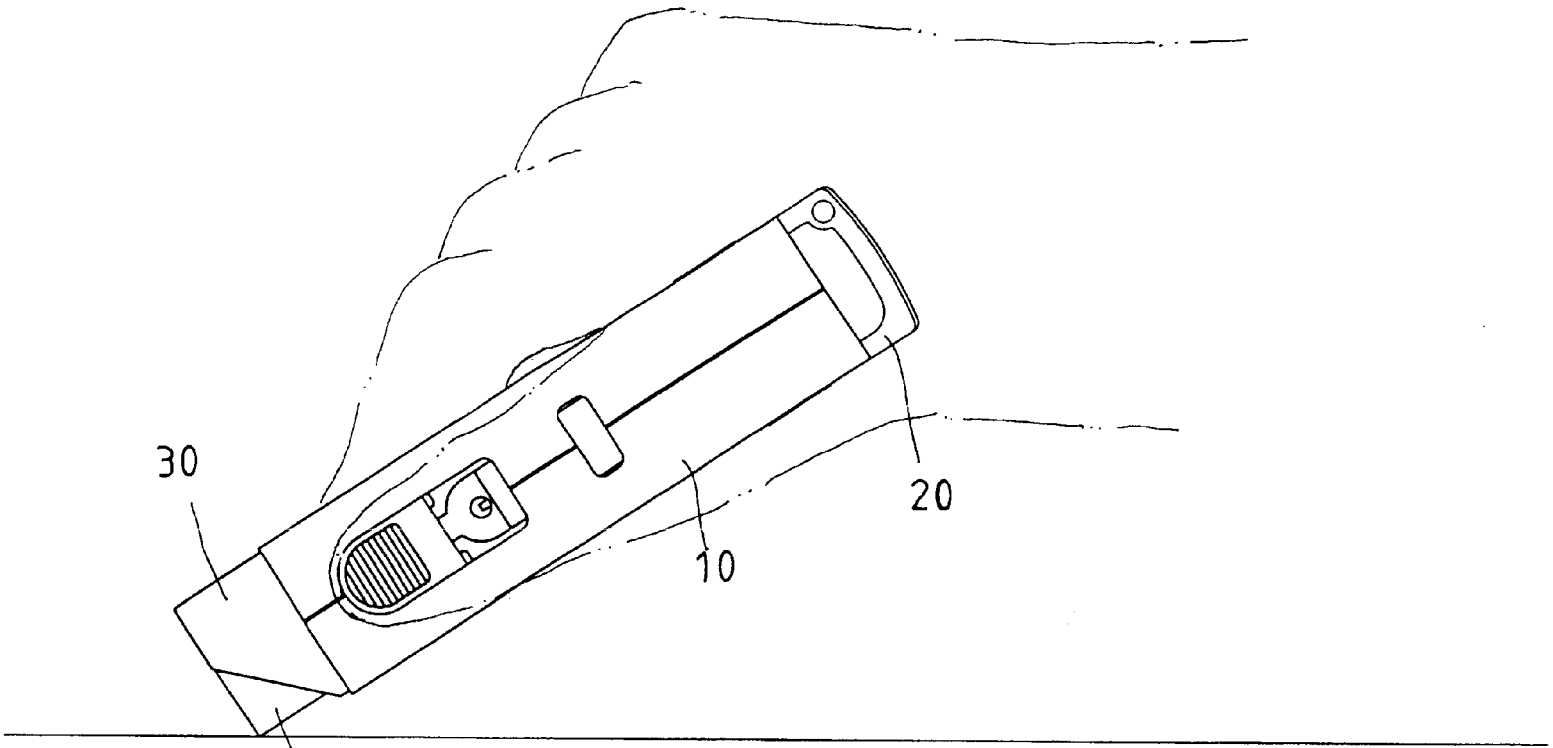
FIG. 17 shows the using condition of present invention.

As shows in FIGS. 16 and 17, before the knife is used, the push knob 323 is pushed with finger in the direction toward the interior of the main body along the long hole 14 of the main body, thereby actuating the guide member to move to jut out of the main body. In the meantime, the spring 40 is stretched to store a recovery spring force. In light of the push knob being under pressure, the pressure causes the pliable arm plate 315 to cave in slightly, so as to enable the slanted block to slide smoothly into the main body at the time when the guide member is in motion. The guide member is jutted out of the main body to expose the blade 50 for use in the art work. As the push knob 323 is let go, the guide member is forced by the recovery spring force of the spring to retract into the main body such that the slanted protuberance 316 is once again retained in the through hole 15.

What is claimed is:

1. An artist's knife comprising:

a main body of a rectangular construction and provided in an interior thereof with a receiving compartment and in two longitudinal ends thereof with a through port in communication with said receiving compartment, said main body provided in one side with a long hole extending along the longitudinal direction of said main body;

an end retaining member disposed at said through port of one end of said main body;

a guide member movably disposed in said main body such that said guide member moves along the longitudinal direction of said main body to jut out of said through port of other end of said main body, said guide member provided in one end with a notch and a push knob corresponding in location to said long hole of said main body;

a blade is disposed in said notch and one end angle portion is jutted out of the notch, said blade is concealed in said main body at the time when said guide member is not jutted out of said main body, and that said blade is jutted out of said main body at the time when said guide member is jutted out of said main body;

an elastic member disposed in said main body such that one end of said elastic member is retained by said end retaining member, and that other end of said elastic member is retained by said guide member, the spring provides the guide member with a recovery force enabling the guide member to return to its original position after each displacement;

wherein said main body is provided in said one side thereof with a through hole; wherein said guide member is provided at one end with a pliable arm plate which is provided with a slanted protuberance whereby said slanted protuberance is retained in said through hole of said main body at the time when said guide member is not extracted out of said main body;

wherein said guide member is provided in two longitudinal sides thereof with a guide arm extending along the longitudinal direction of said guide member, said pliable arm plate is located between said two guide arms whereby said two guide arms are inserted into said main body;

wherein said two guide arms of said guide member are provided with a long guide groove; and wherein said end retaining member has two long arm portions each is provided with a pillar extending along the short axial direction of said retaining member; wherein said end retaining member is disposed in said main body such that said two pillars are located in said long guide grooves of said two guide arms.

2. The artist's knife as defined in claim 1, wherein said end retaining member has a body plate portion which is provided at one longitudinal end thereof with an end cover portion, and at other longitudinal end thereof with said two long arm portions extending outward whereby said long arm portions are inserted into said through port of said one end of said main body such that said end cover portion is jutted out of said main body.

3. The artist's knife as defined in claim 2, wherein said body plate portion of said end retaining member is provided in two longitudinal sides with a retaining projection; wherein said main body is provided with two retaining holes corresponding in location to said retaining projection whereby said end retaining member is disposed in said main body such that said two retaining projections are retained in said two retaining holes.

* * * * *